US006820750B2

(12) United States Patent
Gambini

(10) Patent No.: US 6,820,750 B2
(45) Date of Patent: Nov. 23, 2004

(54) DEVICE FOR THE ELIMINATION OF TRIMMINGS OF ROLLS OR LOGS OF MATERIAL IN STRIPS

(76) Inventor: Giovanni Gambini, Via A Omodeo 7, I - 56124 Pisa (IT)

( * ) Notice: Subject to any disclaimer, the term of this patent is extended or adjusted under 35 U.S.C. 154(b) by 99 days.

(21) Appl. No.: 10/194,615

(22) Filed: Jul. 12, 2002

(65) Prior Publication Data

US 2003/0024793 A1 Feb. 6, 2003

(30) Foreign Application Priority Data

Jul. 31, 2001 (IT) ..... MI2001A1667

(51) Int. Cl.[7] ..... B07C 5/12; B07C 13/07

(52) U.S. Cl. ..... 209/681; 209/659; 209/665; 209/684; 209/685; 209/621; 209/622

(58) Field of Search ..... 209/659, 665, 209/681, 684, 685, 621, 622, 623, 624

(56) References Cited

U.S. PATENT DOCUMENTS 3,905,260 A * 9/1975 Nystrand ..... 83/155
4,265,361 A * 5/1981 Schroeder
4,462,287 A * 7/1984 Weis et al. ..... 83/104
5,458,033 A * 10/1995 Wierschke ..... 83/104
5,475,917 A * 12/1995 Biagiotti ..... 29/822
5,873,450 A * 2/1999 Rusch et al. ..... 198/415
6,152,292 A * 11/2000 Matteucci et al. ..... 198/626.1
6,332,527 B1 * 12/2001 Wierschke ..... 198/369.7
6,371,304 B2 * 4/2002 Gambini ..... 209/620
6,607,082 B2 * 8/2003 Biagioni et al. ..... 209/620

* cited by examiner

*Primary Examiner*—Donald P. Walsh
*Assistant Examiner*—Jonathan R Miller
(74) *Attorney, Agent, or Firm*—Hedman & Costigan, P.C.

(57) ABSTRACT

A device for the elimination of trimmings of rolls or logs of ribbon-like material that can be connected below a cropper machine of at least one roll or log, in turn fed by a feed surface (11) of rolls (12) and top and/or tail crop ends (21), one after another, comprising, below of the feed surface (11), at least one conveyor element (16) closed in a ring which moves around a pulley (14) and which receives the rolls (12) and top and/or tail crop ends (21) on an upper section, the conveyor element (16) having an opening (17) with a dimension at least equivalent to the diameter of a log, inside which the top and/or tail crop ends (21) fall, the opening (17) being positioned as the conveyor element (16) rotates at the beginning of the upper section when the top and/or tail crop ends (21) reach this point.

12 Claims, 3 Drawing Sheets

DEVICE FOR THE ELIMINATION OF TRIMMINGS OF ROLLS OR LOGS OF MATERIAL IN STRIPS

Figure 1:
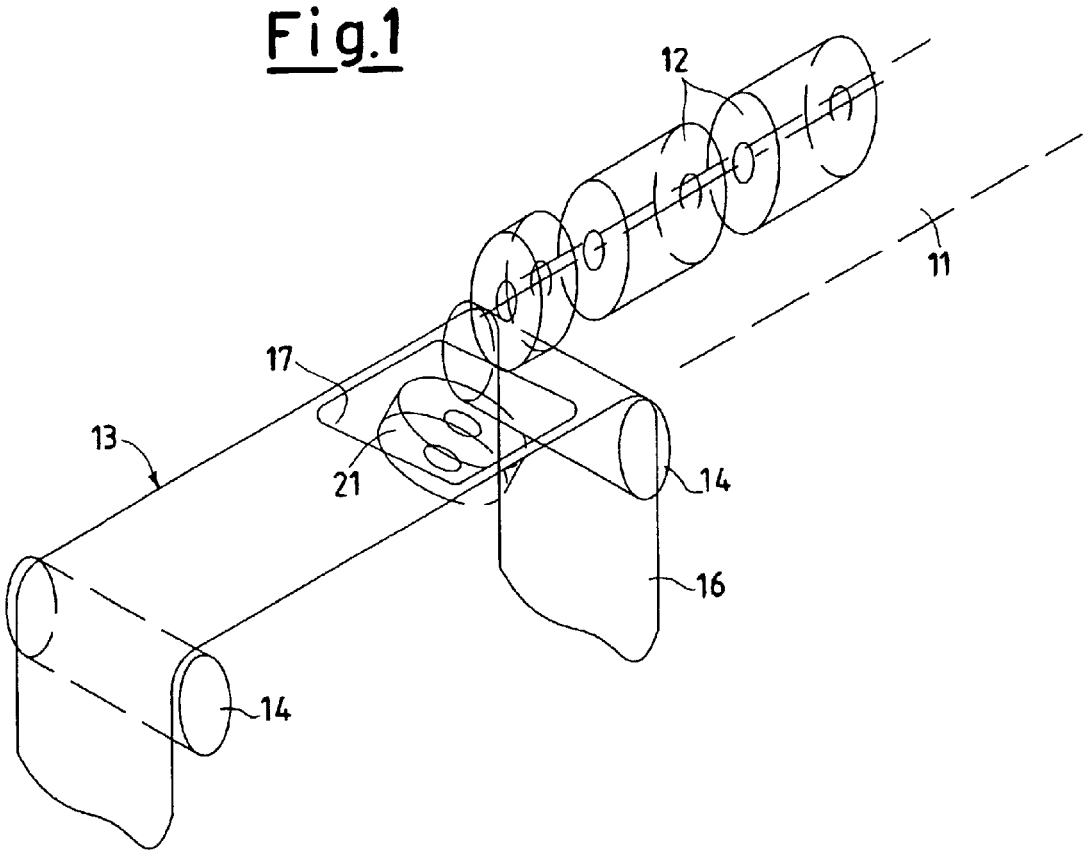

The present invention relates to a device for the elimination of trimmings of rolls or logs of ribbon-like material, in particular which can be connected to a cropper machine.

It is well known that to produce rolls or similar of kitchen towel and/or toilet tissue rolls of paper are first formed wound on logs of a pre-selected diameter and a certain height. Subsequently, the single rolls must be cut to size ready for distribution and direct final use by the consumer.

Currently, these finished rolls are cut to a predetermined size by specific cropper machines which receive, for example, a series of logs and cut them into a plurality of shorter rolls in succession, each to the exact dimensions required. This operation on cropper machines, generally performed by rotating blades, leads to the creation, on a log or roll that is fed step by step, of a plurality of portions of the required size.

Nonetheless, both at the top end of each log or roll and at the tail end portions, which are unusable, are produced in the form of crop ends of a limited length. Moreover, a small core portion, also unusable, may also project from these portions and, therefore, both of them must be eliminated. Furthermore, these crop ends or trimmings of the rolls must be eliminated during evacuation of the rolls cut to size to in order not to obstruct packaging.

The presence of trimmings or crop ends could in fact also cause the packaging machine to block, not to mention packages in which the number of usable rolls could be incorrect due to the presence of these crop end rolls.

Complicated devices have been designed to allow trimmings or crop ends to be eliminated by suction of the rolls cut to the correct size advancing one after another, with crop ends advancing towards an opening, inside which the advancing trimmings or top and tail crop ends, coming from the cropper machine, fall.

These devices, although operating very well and in an essentially correct manner, determine a complicated machine design (suction, releases, synchronization, etc.). Moreover, adjustment must be performed between all the additional parts required both for suction of the rolls and transport of these.

The suction, which acts on the external part of the advancing roll, may also cause external roughening and damage to the product, and subsequently a final external appearance that is not entirely satisfactory.

A further example of a known device for the elimination of trimmings comprises an opening connected to which are two retractable surfaces that open and/or close it as a function of the cut product being conveyed. In fact, this envisages a retractable surface that closes the opening once the top trimming has passed and a retractable surface that operates when the tail trimming arrives, or when rolls cut to the correct size start to pass. In any case, one of the retractable surfaces keeps the opening closed when the rolls cut to size pass, allowing these to advance towards packaging.

This device also operates well, although it can cause problems related to perfectly synchronised movement between the two retractable surfaces and the conveyors to feed the rolls and crop ends in succession.

Moreover, correlation of the movements between the two retractable surfaces and advance of the rolls and crop ends can cause some problems of adjustment with possible jamming.

An object of the present invention is to produce a device for the elimination of the trimmings of rolls or logs of ribbon-like material, in particular which can be connected to, and at the outlet of, a cropper machine, which solves the technical problems set down above.

Another object is to produce a device for the elimination of the trimmings of rolls or logs of material in strips which allows correct elimination of the top and tail trimmings of the initial logs or rolls.

Yet another object is to produce a device for the elimination of the trimmings of rolls or logs of material in strips which is extremely simple to manufacture and easy to use.

Yet another object is to produce a device for the elimination of the trimmings of rolls or logs of material in strips which can keep pace with the high operating rates of the cropper machine, although having a simple structure and requiring very few synchronizations.

These objects according to the present invention are attained by producing a device for the elimination of the trimmings of rolls or logs of material in strips, in particular which can be connected to a cropper machine, as set down in claim 1.

Further characteristics of the invention are set down in the subsequent claims.

Figure 2:
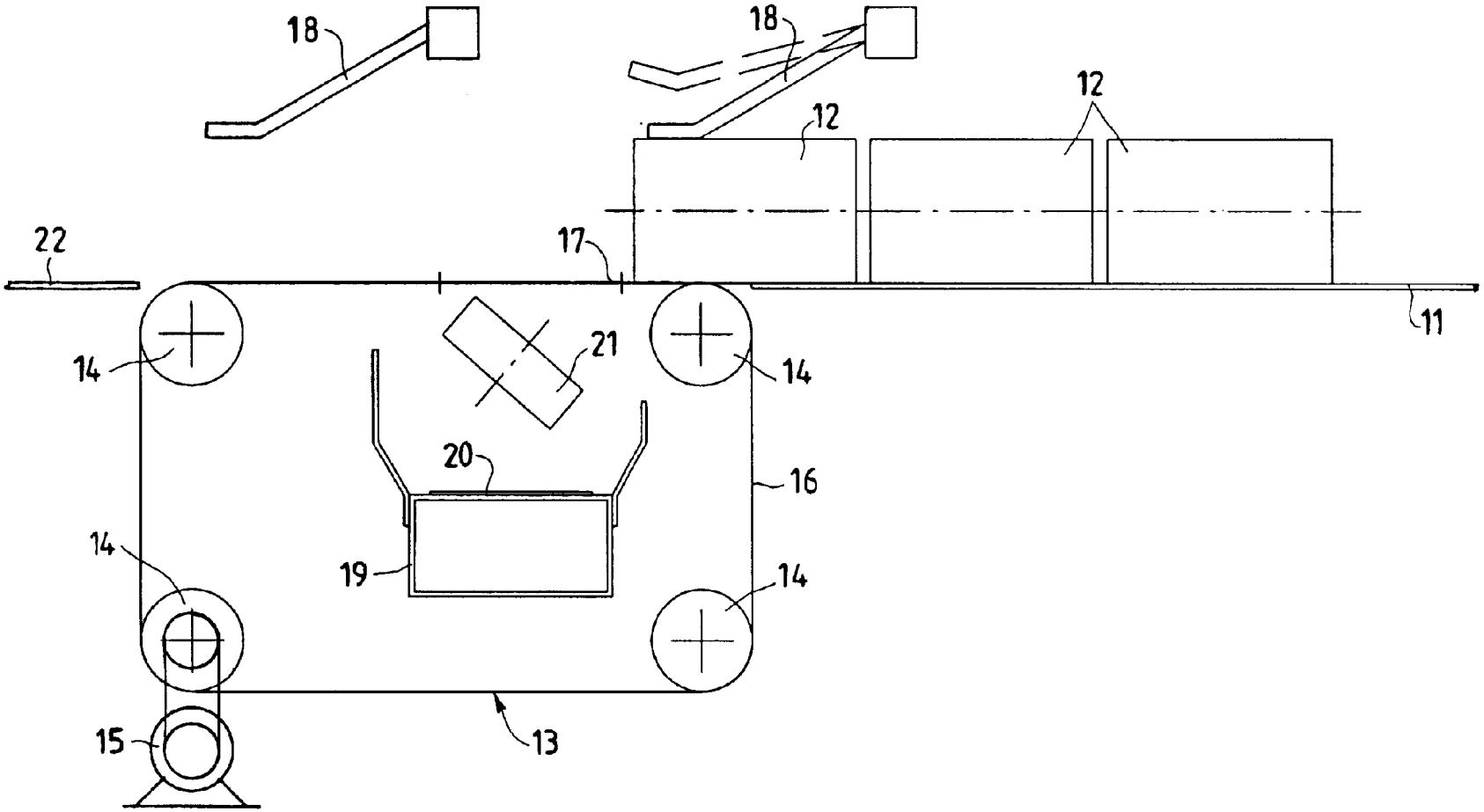
Figure 3:
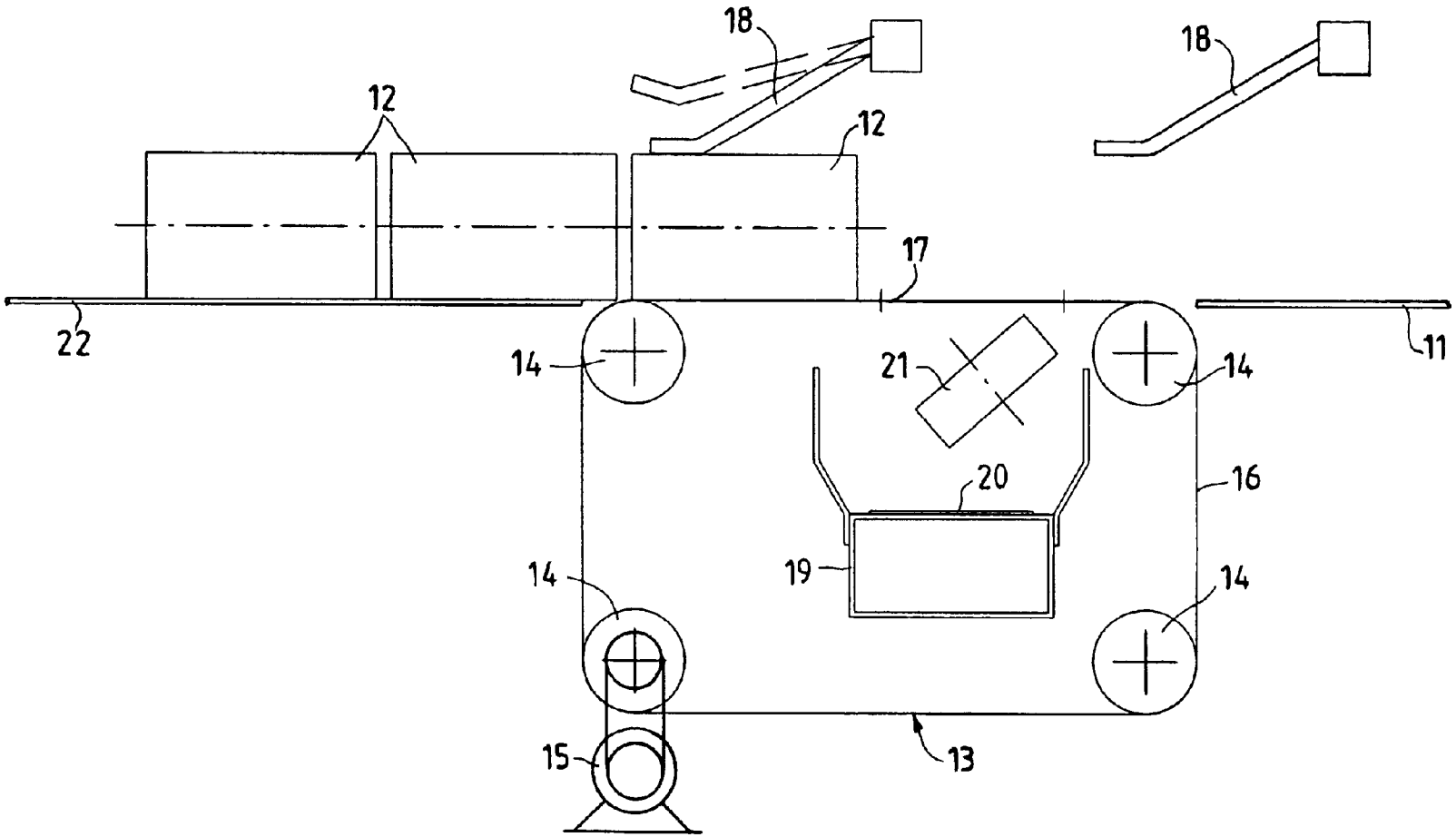

The characteristics and advantages of a device for the elimination of the trimmings of rolls or logs of material in strips, in particular which can be connected to a cropper machine, according to the present invention, will become more apparent from the following description, provided by way of a non-limiting example, with reference to the attached schematic drawings, in which:

FIG. 1 is a perspective view of a device for the elimination of the trimmings of rolls or logs of material in strips, positioned below of a cropper machine, not shown, and produced according to the present invention, FIG. 2 is a schematic side elevation view of the device shown in FIG. 1, and FIG. 3 is a side elevation view of a different position of the device in FIGS. 1 and 2 and of the relative rolls and crop ends to be eliminated.

With reference to the figures, a device for the elimination of trimmings of rolls or logs of material in strips is shown, in particular of the type that can be placed below a cropper machine.

In fact, a conveyor or a feed surface 11, of the pusher or another type, must determine advance of the cut rolls 12 in a row one after another, towards a packaging zone (not shown).

In the example, the device according to the invention is schematized to act on only one row, although it can be used for several rows parallel to one another, all coming from a cropper machine (not shown), as in the majority of cases.

This feed surface 11 faces, according to the invention, a conveyor 13 closed in a ring around pulleys 14, one of which is motor-driven in 15.

The conveyor 13 in fact comprises a conveyor element 16, for example in metal, which is provided with an opening 17 of a dimension almost equivalent to the diameter of a cut and finished roll or log 12, ready for packaging. In the example, the conveyor element 16 is a belt, although it may alternatively be composed of a pair of chains bearing transverse slats, in which the aforesaid opening 17 is produced.

This opening 17 moves as the belt or similar 16 moves and in a preferred embodiment the belt 16 is produced to almost the same length as a whole log, before this is cut (not shown).

It is natural that if there are several rows of rolls 12 side by side cut from the same number of logs side by side, it is either necessary to provide a belt 16 of the same width as the rows of rolls 12 or the same number of individual belts 16 as the rows of rolls.

Above the belt 16, appropriately spaced, are friction elements or blades 18 that interact with the passing rolls 12.

In general these blades 18 can be of the elastic type and engage above the rolls 12 holding them in contact with the belt 16. In any case, as shown in the figures, these blades can be adjusted in height as a function of the dimensions of the maximum diameter of the roll and are positioned both on the feed surface 11 and on an unloading conveyor 22.

Inside the belt 16 of the belt conveyor 13, arranged in a ring, placed under the flat upper section is either a chute or another conveyor 19 of the belt type 20 onto which the top and/or tail crop ends 21 fall. If the belt 16 is multiple or there are several parallel belts 16, this conveyor 19 of the belt type 20 passes inside these, under all the flat sections and receives all the crop ends 21 that fall.

These crop ends 21 come from the cut of the log of material in strips in rolls 12 and are generally named "trimmings".

Operation of a device for the elimination of trimmings of rolls or logs of material in strips according to the present invention is immediately comprehensible.

In fact, the logs, after being produced by winding paper for various uses around a core, are fed towards a cropper machine where they are made into finished rolls 12.

These rolls 12 are generally obtained with a cropper machine that acts according to a programmed sequence to cut the log or logs fed parallel to one another into a plurality of rolls 12.

This operation also produces at the top and tail of each log a trimming or crop end 21 that, as such must be eliminated, before packaging in the process line.

For this purpose, after the log or logs have been cut, the rolls 12 and crop ends 21 advance towards the device of the present invention, as shown in the figures, on the feed surface 11.

Therefore, there are one or more crop ends 21, parallel with one another on several rows, at the top of the cut log or logs, followed by a certain number of rolls 12 in succession one after another.

At this point, as shown in FIGS. 1 and 2, the trimming or crop end 21 advances along the flat upper section of the belt 16 of the conveyor 13 and finds the opening 17. It is thus obliged to fall into this onto the other conveyor 19 positioned underneath.

The belt 16 then starts to advance receiving the rolls 12 in a row one after another and then deposits the rolls on the unloading belt 22.

The presence of friction elements or blades 18, which interact with the rolls 12, facilitates passage of the rolls 12 in the vicinity of the belt 16, thus preventing the rolls from falling into the opening 17.

Before the row of rolls 12 ends, the belt 16 rotating around the pulleys 14, returns the opening 17 almost to underneath the feed line 11 ready to resurface in the flat upper section of the device of the invention.

This occurs when the last roll 12 has passed and the trimming or tail crop end 21 arrives.

This trimming or tail crop end 21 thus falls inside the opening 17, also onto the other conveyor 19 underneath.

This completes the operating cycle of the device of the present invention for a cut log or for rolls 12 and head and tail trimmings 21 produced by the cropper machine.

This is also applicable, as already mentioned several times, if there are several logs and various devices or a single multiple device for the elimination of trimmings 21.

To sum up, when the belt 16 rotates the opening 17 is positioned at the beginning of the upper section of the belt 16 when the top and/or tail crop ends 21 reach this. All this occurs in the same way when the belt is replaced by a pair of chains bearing transverse slats.

It has thus been seen that a device for the elimination of trimmings from rolls or logs of material in strips according to the present invention attains the objects indicated previously.

The device for the elimination of trimmings of rolls or logs of ribbon-like material of the present invention thus conceived may be subjected to numerous modifications and variants, without departing from the scope of the same inventive concept.

Moreover, in practice the materials used, as well as their dimensions and the components, may be any whatsoever according to technical requirements.

What is claimed is:

1. Device for the elimination of trimmings of rolls or logs of material in the form of ribbons said device being adapted to be positioned downstream of a cropper machine adapted to cut at least one roll or log, in turn fed by a feed surface (11) of rolls (12) and top and/or tail crop ends (21), one after another wherein said device comprises downstream from feed surface (11), at least one conveyor element (16) closed in a ring which moves around pulleys (14) and receives the rolls (12) and top and/or tail crop ends (21) on an upper section, the conveyor element (16) having an opening (17) of a dimension at least equivalent to the diameter of a log, into which the top and/or tail crop ends (21) fall, the opening (17) being positioned when the conveyor element (16) rotates at the beginning of the upper section when the top and/or tail crop ends (21) reach said beginning of the upper section.

2. Device as claimed in claim 1, wherein friction elements or blades (18) which interact above said rolls (12) are provided above said conveyor element (16).

3. Device as claimed in claim 1, wherein said conveyor element (16) is motor driven at one of its pulleys (14).

4. Device as claimed in claim 1, characterized in that wherein downstream said conveyor element (16) an unloading conveyor (22) is provided.

5. Device as claimed in claim 1, wherein said conveyor element (16) is a belt made of metal.

6. Device as claimed in claim 1, wherein said conveyor element (16) is a pair of chains bearing transverse slats.

7. Device as claimed in claim 1, wherein said conveyor element (16) is almost the same length as a log, before said log is cut.

8. Device as claimed in claim 1, wherein a plurality of rows of rolls (12) and top and tail crop ends (21) are received by conveyor element (16) which has a width adequate for said plurality of rows and the same number of openings (17) positioned side by side as the rows of rolls and crop ends.

9. Device as claimed in claim 1, wherein a plurality of rolls (12) and top and tail crop ends (21) are received by a plurality of conveyor elements (16) positioned side by side, each equipped with an opening (17) to receive said rows of rolls and crop ends.

10. Device as claimed in claim 8, wherein each conveyor element (16) of said plurality of conveyor elements positioned side by side is separate from the conveyor element at its side.

11. Device for the elimination of trimmings of rolls or logs of material in the form of ribbons said device being adapted to be connected downstream of a cropper machine adapted to cut at least one roll or log, in turn fed by a feed surface (11) of rolls (12) and top and/or tail crop ends (21), one after another wherein said device comprises downstream from feed surface (11), at least one conveyor element (16) closed in a ring which moves around pulleys (14) and receives the rolls (12) and top and/or tail crop ends (21) on an upper section, the conveyor element (16) having an opening (17) of a dimension at least equivalent to the diameter of a log, into which the top and/or tail crop ends (21) fall, the opening (17) being positioned when the conveyor element (16) rotates at the beginning of the upper section when the top and/or tail crop ends (21) reach said beginning of beginning of the upper section and having friction elements or blades (18) which interact above said rolls (12) are provided above said conveyor element (16).

12. Device for the elimination of trimmings of rolls or logs of material in the form of ribbons said device being adapted to be connected to a cropper machine downstream of a cropper machine and adapted to cut at least one roll or log, in turn fed by a feed surface (11) of rolls (12) and top and/or tail crop ends (21), one after another wherein said device comprises downstream from feed surface (11), at least one conveyor element (16) made of metal which is closed in a ring which moves around pulleys (14) and receives the rolls (12) and top and/or tail crop ends (21) on an upper section, the conveyor element (16) having an opening (17) of a dimension at least equivalent to the diameter of a log, into which the top and/or tail crop ends (21) fall, the opening (17) being positioned so that when the conveyor element (16) rotates to where the top and/or tail crop ends (21) reach said beginning of the upper section, the opening is positioned to receive the top and/or tail crop ends (21) and having friction elements or blades (18) which interact above said rolls (12) are provided above said conveyor element (16) or logs of material in the form of ribbons said device being adapted to be connected downstream of a cropper machine of at least one roll or log, in turn fed by a feed surface (11) of rolls (12) and top and/or tail crop ends (21), one after another, wherein it comprises below the feed surface (11), at least one conveyor element (16) closed in a ring which moves around pulleys (14) and receives the rolls (12) and top and/or tail crop ends (21) on an upper section, the conveyor element (16) having an opening (17) of a dimension at least equivalent to the diameter of a log, into which the top and/or tail crop ends (21) fall, the opening (17) being positioned so that when the conveyor element (16) rotates to where the top and/or tail crop ends (21) reach said beginning of the upper section, the opening is positioned to receive the top and/or tail crop ends (21) and having friction elements or blades (18) which interact above said rolls (12) are provided above said conveyor element (16).

* * * * *